United States Patent [19]

Henrici et al.

[11] Patent Number: 4,744,767

[45] Date of Patent: May 17, 1988

[54] SWINGABLE SOCKET FOR LAMPS

[75] Inventors: Dieter Henrici; Alfred Bothe, both of Arnsberg, Fed. Rep. of Germany

[73] Assignee: Brokelmann, Jaeger & Busse GmbH & Co., Arnsberg, Fed. Rep. of Germany

[21] Appl. No.: 52,134

[22] Filed: May 18, 1987

Related U.S. Application Data

[63] Continuation of Ser. No. 814,111, Dec. 27, 1985, abandoned.

[30] Foreign Application Priority Data

Jan. 9, 1985 [DE] Fed. Rep. of Germany ..... 3500453

[51] Int. Cl.[4] ..... H01R 33/08

[52] U.S. Cl. ..... 439/226; 439/558

[58] Field of Search ..... 439/225, 226, 230, 231, 439/232, 234, 235, 236, 237, 238, 239, 558, 602, 375, 280

[56] References Cited

FOREIGN PATENT DOCUMENTS

| | | | |
|---|---|---|---|
| 308240 | 6/1973 | Austria . | |
| 2016087 | 10/1971 | Fed. Rep. of Germany | 339/56 |
| 7234735 | 12/1972 | Fed. Rep. of Germany . | |
| 7515315 | 11/1976 | Fed. Rep. of Germany . | |
| 2559818 | 7/1980 | Fed. Rep. of Germany . | |
| 1326164 | 12/1962 | France | 339/50 R |

*Primary Examiner*—Gil Weidenfeld
*Assistant Examiner*—Thomas M. Kline
*Attorney, Agent, or Firm*—Karl F. Ross; Herbert Dubno

[57] ABSTRACT

A mounting device for a fluorescent lamp includes a socket which is swingably supported in a socket holder for being movable between an inclined position and an operational position and is provided with a socket body and a locking member extending in axial direction rearwardly away from the connection of the lamp to the socket body. The socket holder has an opening through which the socket body projects with its locking member. in order to encompass the respective inner surface of the opening in a pinless hinge-like member. For limiting the swiveling movement of the socket, the socket body is provided with a stop member which cooperates with the innerside of the holder.

2 Claims, 4 Drawing Sheets

SWINGABLE SOCKET FOR LAMPS

This is a continuation of co-pending application Ser. No. 814,111 now abandoned filed on Dec. 27, 1985.

FIELD OF THE INVENTION

Our present invention refers to a swingable socket for lamps especially for unilaterally mounted compact flourescent lamps.

BACKGROUND OF THE INVENTION

There are known tube lamps which are bilaterally mounted by inserting them transversely to their longitudinal axes into respective sockets. For assembling or disassembling such lamps, there is no special space necessary in front of the end faces of the sockets so that the lamp casing can be provided adjacent to the outer sides of the sockets.

In recent years, however, unilaterally mounted fluorescent lamps have been increasingly used which have a base plugged into the socket in axial direction of the lamp. Consequently, a clearance is required in axial direction behind the lamps for allowing the insertion or removal of such a lamp into or from the socket. A further disadvantage of such connections is that the socket is not entirely visible when inserting the lamp thus rendering the insertion rather difficult.

It has thus been proposed to use swingable sockets which are provided with a socket body of insulating material accommodating the electrical connections and having a base portion releasably connected to a holder in such a manner that the socket body is swingable about a swivel axis. The socket body and the base portion are two separate plastic parts, whereby the base portion is a U-shaped bracket whose web is connected to the socket holder by two screws while its shanks includes boreholes for journals arranged on the socket body. Such a connection is disadvantageous as it is still necessary to screw the bracket-like base portion to the socket holder.

OBJECT OF THE INVENTION

It is thus the principal object of our present invention to provide an improved swingable socket obviating the afore-stated drawbacks.

SUMMARY OF THE INVENTION

We realize this object, in accordance with the present invention, by providing a socket which is swingably supported in a socket holder for moving between an inclined position and an operational position and is provided with a socket body and a locking member extending rearwardly in axial direction away from the connection of the lamp to the socket body to encompass the inner surface of an opening in the socket holder so that the inner surface defines the swivel axis about which the socket body swings.

According to the essential feature of the invention, the socket is thus connected to the holder in a pinless hinge-like manner by swinging about the inner surface of the openings.

For limiting the swiveling of the socket, the socket body is provided with a stop member which cooperates with the innerside of the holder.

In accordance with a first embodiment of the invention, the socket body is provided with a base portion and a claw-like locking member which projects rearwardly from the base portion and is inserted into the opening so as to encompass the inner surface of the opening. By connecting onto the locking member a catch which cooperates with a further through-hole in the socket holder, the socket is maintained in close connection with the holder when moved into the inclined position as the catch sufficiently penetrates the through-hole.

Alternatively to the claw-like locking member, we can use a semicircular hook which is connected with its one end directly to the socket body and whose other exposed end cooperates with a respective through-hole in the socket body so that the hook encompasses the inner surface of the opening to provide the hinge-like connection and penetrates sufficiently the through-hole to maintain the connection between socket holder and socket when the latter is in the inclined position.

The advantage of the present invention resides in that a socket is provided which unilaterally supports the fluorescent lamp and through the inventive design of its socket body can easily be moved between an inclined and operational i.e. horizontal position. Thus, the invention utilizes snap-in sockets which are known per se e.g. from German patent document (utility model) No. 72 34 735 without losing, however, the connection to the socket holder during the limited swiveling action.

For maintaining the operational position of the socket to the holder, a spring bolt or a resilient snap pin are used which cooperate with a respective through-hole in the socket body.

According to a further feature of the invention, the exposed surface of the catch or hook define with the opposing surface of the stop member a gap whose width is at most the wall thickness of the socket body. Thus, the catch or hook form with the stop member a part of a slotted and thus pluggable hinge whose other part is defined by the swivel axis about the inner surface of the opening. The obtained gap permits a plug-in connection of the socket with the holder via its respective opening and through-holes so that after providing the connection a hinge is obtained allowing the movement of the socket between the inclined and operational positions.

BRIEF DESCRIPTION OF THE DRAWING

The above and other objects, features and advantages of our present invention will become more readily apparent from the following description, reference being made to the accompanying drawing in which.

SPECIFIC DESCRIPTION

Figures 1, 1A:
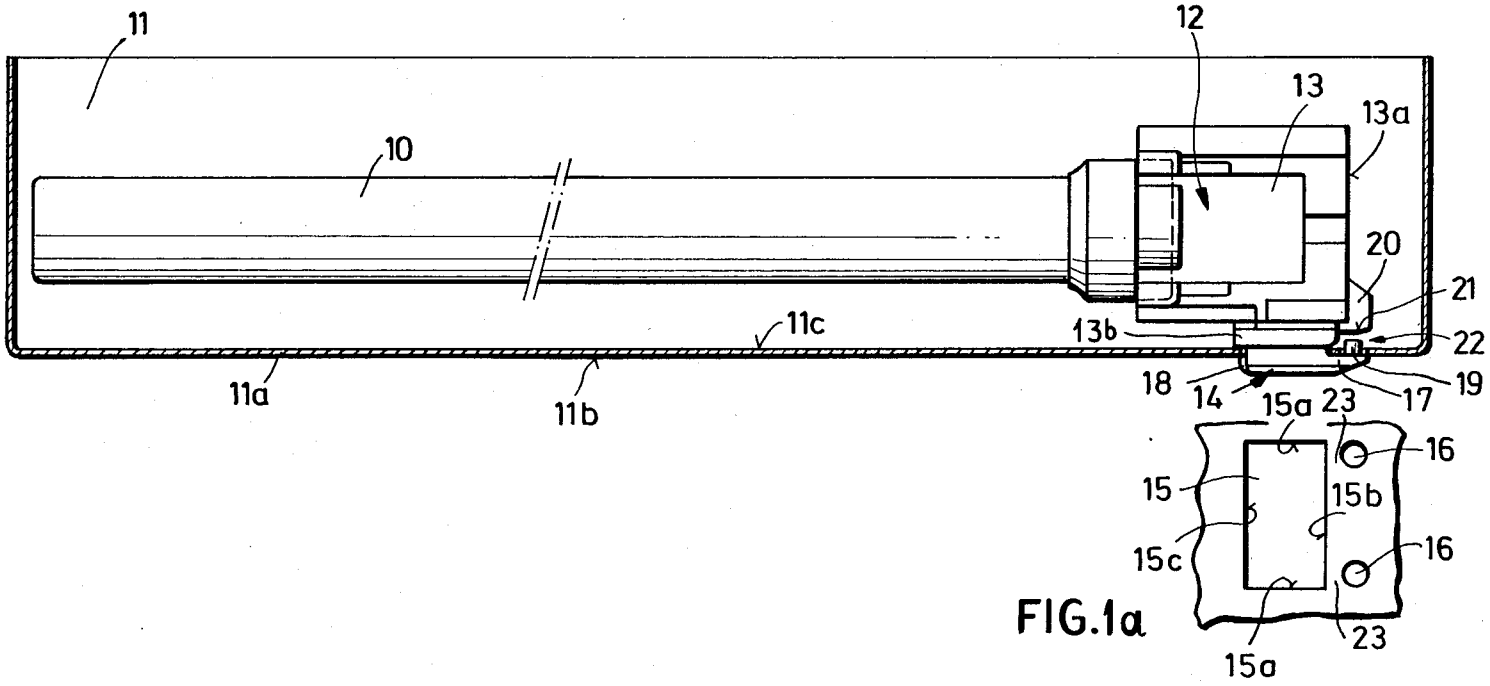
FIG. 1 is a schematic, partial sectional view of one embodiment of a socket arranged in a socket holder for supporting a fluorescent lamp.
FIG. 1*a* is a fragmentary view of the bottom portion of the socket holder of FIG. 1 with the socket and lamp being removed.

In FIG. 1, there is illustrated a socket holder with a trough-shaped casing 11 whose bottom portion 11*a* is connected in a manner to be described hereinbelow to an insulating socket which is generally designated by refreence numeral 12 and supports one end of an otherwise freely hanging fluorescent lamp 10 in the form of a lamp tube having an axis and a connecting base at one axial end of the lamp. The socket 12 includes a socket body 13 which accommodates the electric connections and is provided at its lower end with a support block **13*b* projecting from socket body 13 towards the bottom 11*a*. Connected to the support block 13*b* is a base portion 14 which cooperates with the bottom 11*a* of the socket holder 11 to affix the socket 13 thereto. The socket body 13 and the base portion 14 are preferable one piece and made of the same material. The base portion 14 is integrally provided with a claw-like locking member 17 which projects beyond the rearside 13*a* of the socket body 13 and supports a pair of upright formations which constitute catches 19 arranged at a distance to each other at opposing margins of the locking member 17. The locking member forms a pivot holder which has a member adapted to reach through a rectangular opening 15 in the web 11*a*** at the one end of the light fixture at which the socket is mounted.

As is shown in particular in FIG. **1*a*, the bottom or rear wall 11*a* of the casing is provided with the rectangular opening 15 and two circular through-holes 16 arranged laterally of the opening 15 at the side remote to the lamp 10. The through-holes 16 are spaced from each other and are arranged in vicinity of the narrow sides 15*a* of the opening 15 so that respective webs 23 are defined between the through-holes 16 and the adjacent opening 15. The distance between the through-holes 16 corresponds essentially to the distance of the formations or catches 19. The formations 19 thus reach through the holes 16 when the socket is swung about an axis perpendicular to the tube axis until the tube axis lies substantially perpendicular to the wall 11*a***.

At the side opposite to the inner surface of soffit **15*b* of the opening 15, the base portion 14 is provided with a spring bolt or resilient catch 18 which exerts a pressure against the inner surface 15*c* of the opening 15 to secure the socket 12 to the holder 11 when the lamp 10 is in the operational position as shown in FIG. 1. The spring bolt 18 has an essentially semicircular outer contour which allows a retraction thereof upon a certain pressure force or tension force to allow inserting or removing of the socket 12 from the opening 15**.

At its rearside **13*a*, the socket body 13 is provided with a central ribbed stop member or abutment catch whose stop face 21 is spaced from the innerside 11*c* of the bottom 11*a* for defining and limiting the swinging motion of the socket 12 relative to the holder 11, i.e. yieldably retaining the socket in its inclined position for replacement of the tube lamp. In the projection of FIG. 1, the abutment 20 defines with the formations 19 a gap 22 whose width essentially corresponds to the wall thickness of the socket holder 11**.

Figure 2:
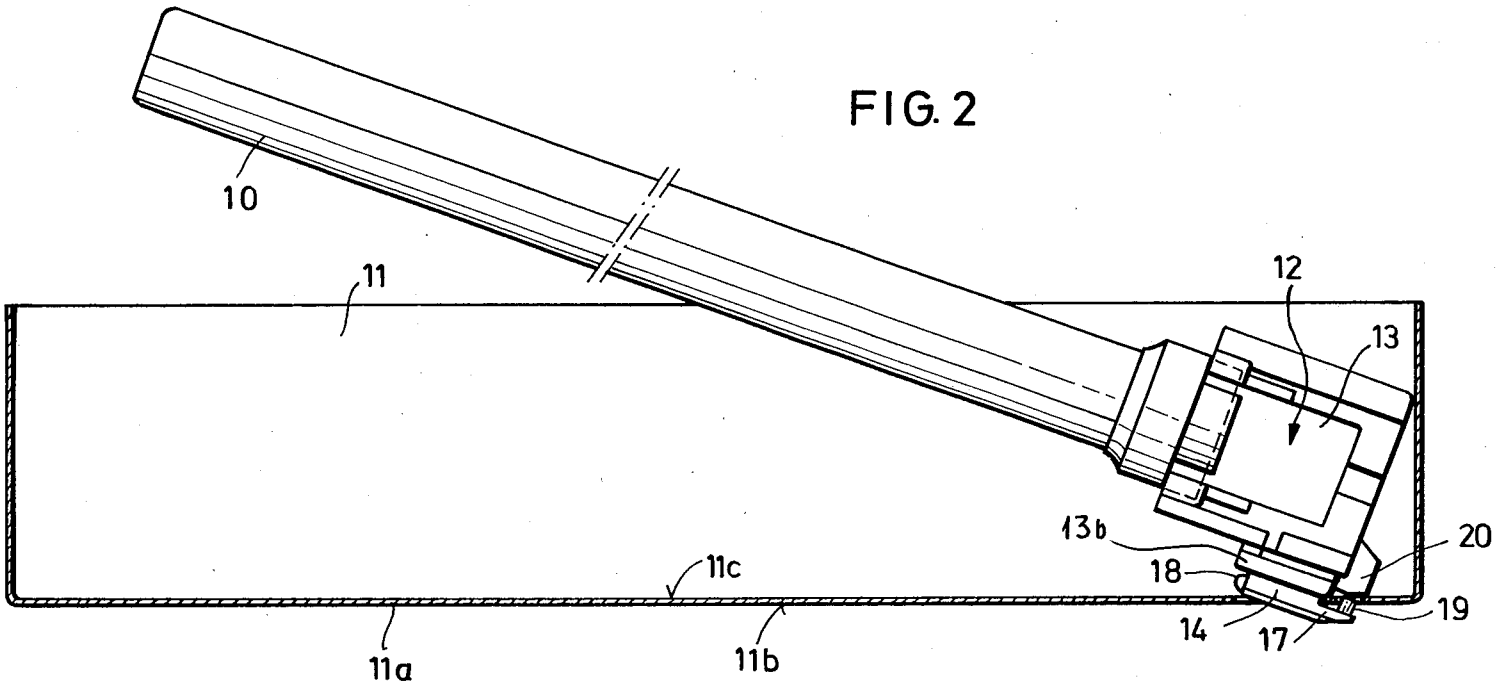
FIG. 2 is a schematic, partial sectional view of the socket of FIG. 1 in an inclined position.

For assembling the arrangement, the socket 12 together with the lamp 10 is brought into an inclined position and its base portion 14 is inserted into the opening 15. By moving the socket 12 backwardly, the webs 23 pass through the gap 22 while the abutment 20 abuts with its stop face 21 against the innerside **11*c* of the socket holder 11. The distance between the formations 19 and the facing surface of the base portion 14 corresponds essentially to the width of the web 23 so that the backward movement of the socket 12 is limited until the inner surface 15*b* of the opening 15 abuts against the base portion 14 at which point the formations 19 project into the aligned through-hole 16 (FIG. 2). Since the gap 22 corresponds essentially to the wall thickness of the bottom 11*a*, the catches 19 engage sufficiently within the through-holes 16 to prevent a self-acting release of the socket 12 from the holder 11 when being in the inclined position as shown in FIG. 2**.

The socket 12 with the lamp 10 is then pushed downwardly until occupying its horizontal, operational position (FIG. 1) whereby the formations 19 completely enter the associated through-holes 16. During the downward movement, the spring bolt or catch 18 is retracted by the inner surface **15*c* and exerts a sufficient force thereagainst to secure together with the formations 19 the connection of the socket 12 to the socket holder 11. When the base portion 14 is in the position as shown in FIG. 1, the support block 13*b* rests on the innerside 11*c* of the bottom 11*a* to support the socket 12 against the socket holder 11. It is evident that the support block 13*b* has a width exceeding the width of the opening 15**.

By plugging the socket 12 into the holder 11 in this manner a hinge-like connection is provided whose swivel axis is defined by the inner surface **15*b* of the opening 15 against which surface the base portion 14 abuts. In order to facilitate the engagement and disengagement of the socket 12 to and from the socket holder 11, the catches 19 and/or the stop member 20** are made of resilient material.

Figures 3, 3A:
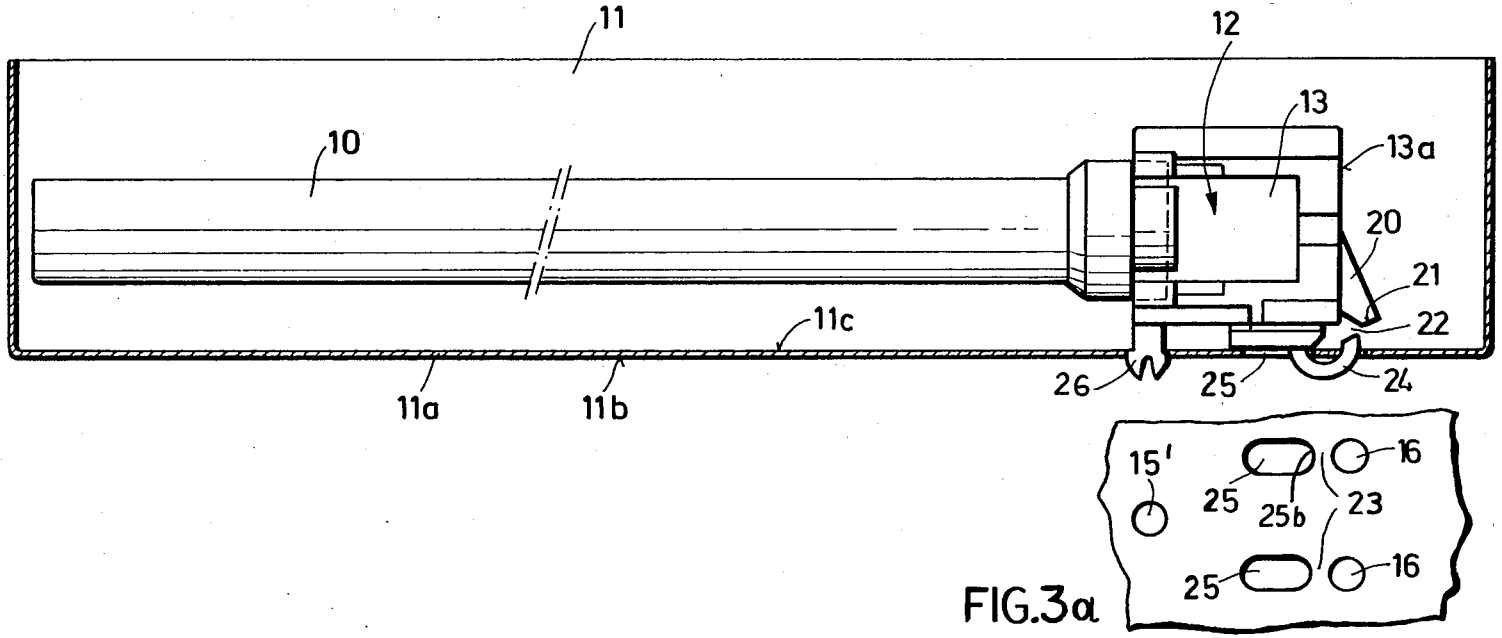
FIG. 3 is a schematic, partial sectional view of another embodiment of a socket arranged in a socket holder for supporting a fluorescent lamp.
FIG. 3*a* is a fragmentary view of the bottom portion of the socket holder of FIG. 3 with the socket and lamp being removed.

Turning now to FIG. 3 which shows another embodiment of the supporting of the socket 12 to the socket holder 11, it can be seen that the support block **13*b* of the socket body 13 is connected to a base portion constituted by a pair of semicircular hooks 24 (in FIG. 3 only one such hook 24 is shown) which are arranged at a distance to each other at opposing margins of the support block 13*a*. Cooperating with the hooks 24 are a pair of oblong openings 25 which are arranged in the bottom 11*a* of the socket holder 11. The length of each opening 25 corresponds essentially to the diameter of the semicircular of the associated hook 24**.

At a distance to the support block **13*b* in vicinity of the lamp 10, the socket 12 is provided with a catch in the form of a snap pin 26 which projects downwardly in vertical direction from the socket body 13 and cooperates with a further opening 15' in the bottom 11*a*. The snap pin 26 is made of resilient material to facilitate disengagement thereof from the opening 15'**.

As is shown in FIG. **3*a*, the bottom 11*a* is further provided with a pair of through-holes 16 which are aligned with the openings 25 and separated therefrom by respective webs 23 and into which the free ends of the hooks 24 constituting formations equivalent to the formations 19**, can extend.

Projecting from the rearside **13*a* of the socket body 13 is the stop member or abutment 20 whose stop face 21 defines with the opposing end of the hooks 24 a gap 22 which essentially corresponds to the wall thickness of the bottom 11*a* so that the hooks 24 engage in the openings 25 when the socket 13 is in the inclined position (FIG. 4) to prevent a disengagement of the socket 12 from the socket holder 11**.

Figure 4:
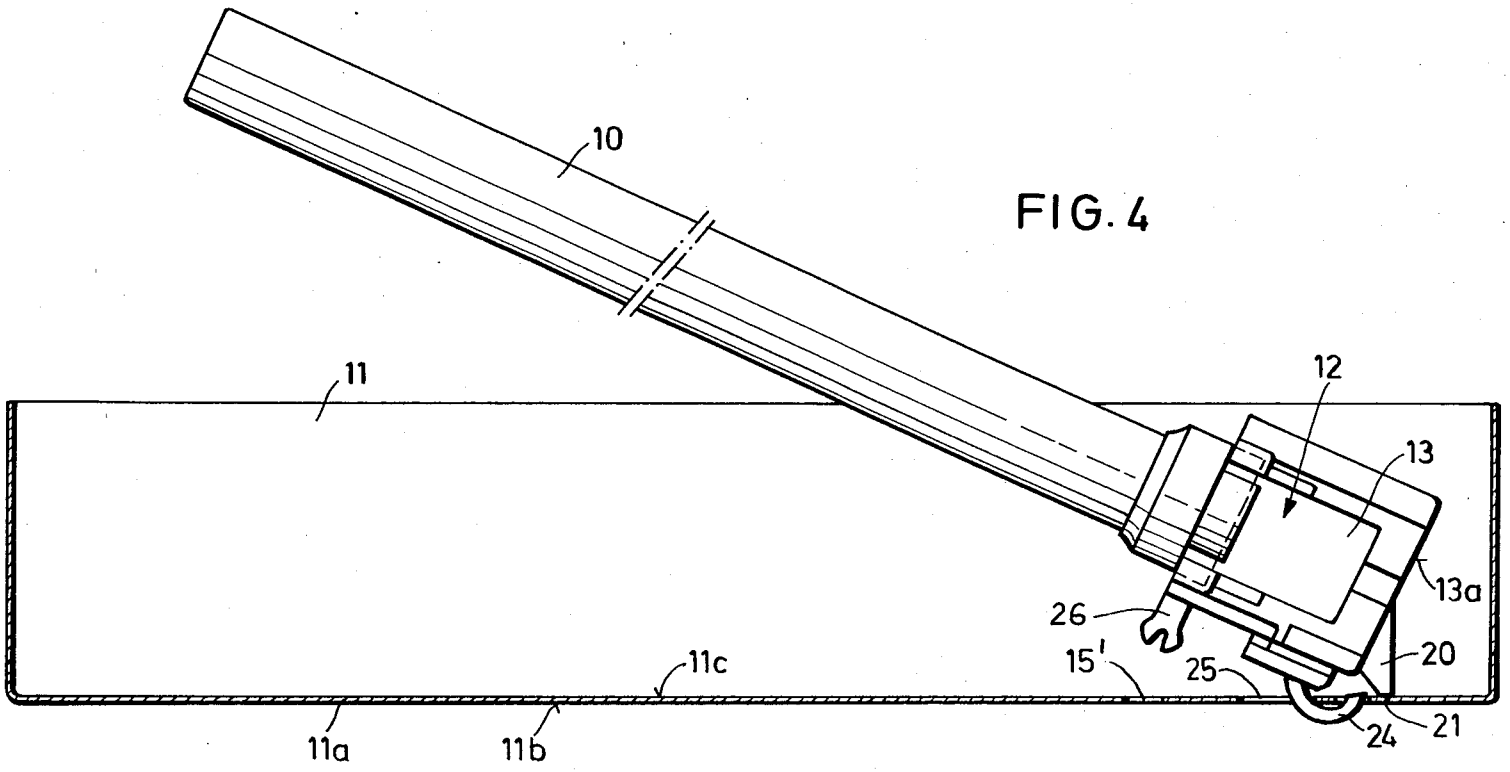
FIG. 4 is a schematic, partial sectional view of the socket of FIG. 3 in an inclined position.

Upon assembly, the socket 12 is brought into the inclined position as shown in FIG. 4 and the hooks 24 are guided through the openings 25. The inclination of the socket 12 is limited by the abutment 20 whose stop face 21 abuts the innerside **11*c* of the bottom 11*a*. The socket 13 is then pushed backwardly until the hooks 24** rest against the respective inner surface 25b of the openings 25 and partly engage in the through-holes 16. The inner surface 25b defines the swivel axis about which the socket 12 swings between the inclined and operational positions. Thereafter, the socket 13 is pushed downwardly so that the hooks 24 occupy the position as shown in FIG. 3 in which they project thorugh the through-holes 16 and the snap pin 26 locks simultaneously into the opening 15' to provide a secure connection between the socket 13 and the socket holder 11.

For exchanging fluorescent lamps 10, the socket 12 of each embodiment is brought into the inclined position, and then the lamp is removed and replaced by a new lamp. The inclined position is securely maintained by the catches 19 or hooks 24 engaging with their free end the through-holes 16.

Advantageously, the hook 24 as well as the catches 19 are made of resilient material to facilitate engagement and disengagement of the socket body 13 from the socket holder 11.

We claim:

1. A light fixture for a tube lamp having an axis and a connecting base at one axial end of said lamp, said fixture comprising:

an elongated holder open at one side and having a wall on an opposite side, said wall being provided with a throughgoing rectangular opening at one end of said holder;

a socket adapted to receive said base mounted in said holder at said one end thereof;

a pivot hook formed on said socket adapted to reach through said opening from the interior of said holder to a rear side of said wall thereby said socket and said lamp are swingable about an axis perpendicular to said lamp axis relative to said holder between a position wherein said lamp axis lies substantially parallel to said wall and a position wherein said tube axis is inclined away from said wall toward said open side of said holder, said hook having a body receivable in said opening, a projection extending from said body away from said lamp, and at a free end of said projection a pin extending perpendicular to said projection and adapted to reach from behind through a respective hole formed in said wall and spaced from said opening when said socket and said lamp are displaced into said position wherein said lamp axis lies substantially parallel to said wall;

a resilient catch on said body on a side thereof opposite that at which said projection extends for releasable engagement with said wall in said position of said socket wherein said lamp axis lies substantially parallel to said wall; and an abutment on said socket directly juxtaposed with said pin for engagement with said wall in said position of said socket wherein said lamp axis is inclined away from said wall toward said open side of said holder to yieldably retain said socket in said inclined position for replacement of said tube lamp, said pin defining a gap with said abutment which is at most substantially equal to the thickness of said wall.

2. A light fixture for a tube lamp having an axis and a connecting base at one axial end of said lamp, said fixture comprising:

an elongated holder open at one side and having a wall on an opposite side, said wall being provided with a pair of laterally spaced throughgoing slot-shaped openings at one end of said holder;

a socket adapted to receive said base mounted in said holder at said one end thereof;

a pair of spaced apart curved pivot hooks formed on said socket and adapted to reach through respective ones of said openings from the interior of said holder to a rear side of said wall whereby said socket and said lamp are swingable about an axis perpendicular to said lamp axis relative to said holder between a position wherein said lamp axis lies substantially parallel to said wall and a position wherein said tube axis is inclined away from said wall toward said open side of said holder, said hooks having free ends adapted to reach from behind through respective holes formed in said wall and spaced from said openings when said socket and said lamp are displaced into said position wherein said lamp axis lies substantially parallel to said wall;

a resilient catch on said socket spaced from said hooks and extending perpendicular to said wall for releasable engagement said wall in a further hole formed in said wall in said position of said socket wherein said lamp axis lies substantially parallel to said wall; and an abutment on said socket at a side thereof at which said hooks are provided and directly juxtaposed with said free ends for engagement with said wall in said position of said socket wherein said lamp axis is inclined away from said wall toward said open side of said holder to yieldably retain said socket in said inclined position for replacement of said tube lamp, said hooks being of semicircular shape and said openings having lengths corresponding substantially to a diameter of said hooks, said free ends defining gaps with said abutment which is at most substantially equal to the thickness of said wall.

* * * * *